US005849157A

United States Patent [19]

Mayer

[11] Patent Number: 5,849,157

[45] Date of Patent: Dec. 15, 1998

[54] OSCILLATING ROLL WITH STATIONARY CLEANING TOOL FOR THE MANUFACTURE OF A CONTINUOUS LAYER OF MATERIAL

[75] Inventor: Wolfgang Mayer, Heidenheim, Germany

[73] Assignee: Voith Sulzer Papiermaschinen GmbH, Heidenheim, Germany

[21] Appl. No.: 800,619

[22] Filed: Feb. 14, 1997

[30] Foreign Application Priority Data

Feb. 17, 1996 [DE] Germany ..... DE 196 05 959.3

[51] Int. Cl.[6] ..... D21G 3/00; D21F 7/00

[52] U.S. Cl. ..... 162/272; 162/281; 15/256.51

[58] Field of Search ..... 162/281, 272, 162/277, 257, 355; 15/256.51, 256.53

[56] References Cited

U.S. PATENT DOCUMENTS

| | | | |
|---|---|---|---|
| 3,013,606 | 12/1961 | Goddard | 162/355 |
| 3,750,228 | 8/1973 | Wake | 162/281 |
| 3,863,453 | 2/1975 | Mercier | 615/256.53 |
| 5,520,782 | 5/1996 | Schiel | 162/358.3 |
| 5,643,416 | 7/1997 | Lange et al. | 162/358.3 |

FOREIGN PATENT DOCUMENTS

| | | | |
|---|---|---|---|
| 1002440 | 3/1983 | U.S.S.R. | 162/355 |

OTHER PUBLICATIONS

MacDonald et al. "Papermaking and Paperboard making" McGraw Hill, p. 288, Fig. 6–44 1970.

*Primary Examiner*—Karen M. Hastings
*Attorney, Agent, or Firm*—Taylor & Associates, P.C.

[57] ABSTRACT

The invention relates to an apparatus to produce a layer of material, such as paper, carton or cardboard. A number of cylinders and rollers carry the continuous layer of material along a meandering path. A stationary cleaning tool acts upon the surface of at least one of the rollers and/or cylinders. The cylinder or roller whose surface the cleaning tool is affecting is mounted so that it is allowed to move in an oscillating fashion relative to the stationary cleaning tool in the direction of the axis of rotation of the cylinder or roller.

5 Claims, 2 Drawing Sheets

OSCILLATING ROLL WITH STATIONARY CLEANING TOOL FOR THE MANUFACTURE OF A CONTINUOUS LAYER OF MATERIAL

BACKGROUND OF THE INVENTION

1. Field of the Invention

The present invention relates to an apparatus for manufacturing a continuous layer of material, and more specifically, a layer of material such as paper, carton or cardboard.

2. Description of the Related Art

It is known to employ cleaning tools in machines that produce a continuous layer of material, particularly in equipment to produce paper. These tools are used for cleaning the surfaces of rollers and cylinders, such as dryer cylinders and/or rollers, and guiding rollers. Such tools incorporate scrapers which act on the surfaces of the rollers and/or cylinders in order to remove dirt and deposits. In order to wear on the surfaces of these rollers and/or cylinders as evenly as possible, the cleaning tools and their scrapers, respectively, are designed so that they work in an oscillating manner. This sort of oscillation implies a relative movement between the cleaning tool and the surface that is being cleaned. These scrapers exert a compressive force upon the surface that is being cleaned that should not be underestimated. The scraper and the beam to which they are attached should possess a considerable stiffness in order to keep the deflection of the tool to a minimum. Thus, the pushing force can act as evenly as possible along the length of the roller/cylinder. This requirement usually leads to relatively complex and rather expensive constructions which tend to occupy very large amounts of space.

What is needed in the art is an apparatus for manufacturing a continuous layer of material which does not have the above mentioned disadvantages.

SUMMARY OF THE INVENTION

The present invention provides a cylinder and/or roller, respectively, that is cleaned by the cleaning tool, and mounted so that it can be moved in an oscillating fashion in the direction of its respective axis of rotation. By providing the possibility of relative movement in this direction one prevents furrows or grooves from forming in the surface of the cylinder and/or roller that requires cleaning. By the same token, the relative movement is also devised to prevent localized wearing at the cleaning surface of the scraper of the cleaning tool.

In one embodiment of the present invention, a driving mechanism, which is to facilitate the axial movement of the roller and/or cylinder, is located on one end of this roller and/or cylinder. The spatial requirements of such a driving mechanism are relatively small. Furthermore, this arrangement does not excessively constrain the access to the apparatus for producing material layers, which would be required for example for cleaning, maintenance or for process control.

In another embodiment of the present invention, a spring system is attached at the end of the roller and/or cylinder which is opposite to the side where the driving mechanism is mounted. The spring force acts counter to the direction of the driving mechanism. This arrangement avoids the necessity of having the driving mechanism move the roller and/or cylinder in both directions. The spring system facilitates the movement of the roller and/or cylinder in the opposite direction.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

The apparatus for producing layers of material described hereinafter is particularly suited for producing paper. The apparatus includes a number of cylinders, e.g., dryer cylinders and rollers. Rollers may include, e.g., guiding rollers which guide and support a dryer sieve, which is sometimes also referred to as a conveyer band, and carrier rollers and implements of that sort. It is to be understood that the term "roller", "rollers" or the like, as used herein, refers to both cylinders such as dryer cylinders as well as to rollers such as guiding rollers.

Figure 1:
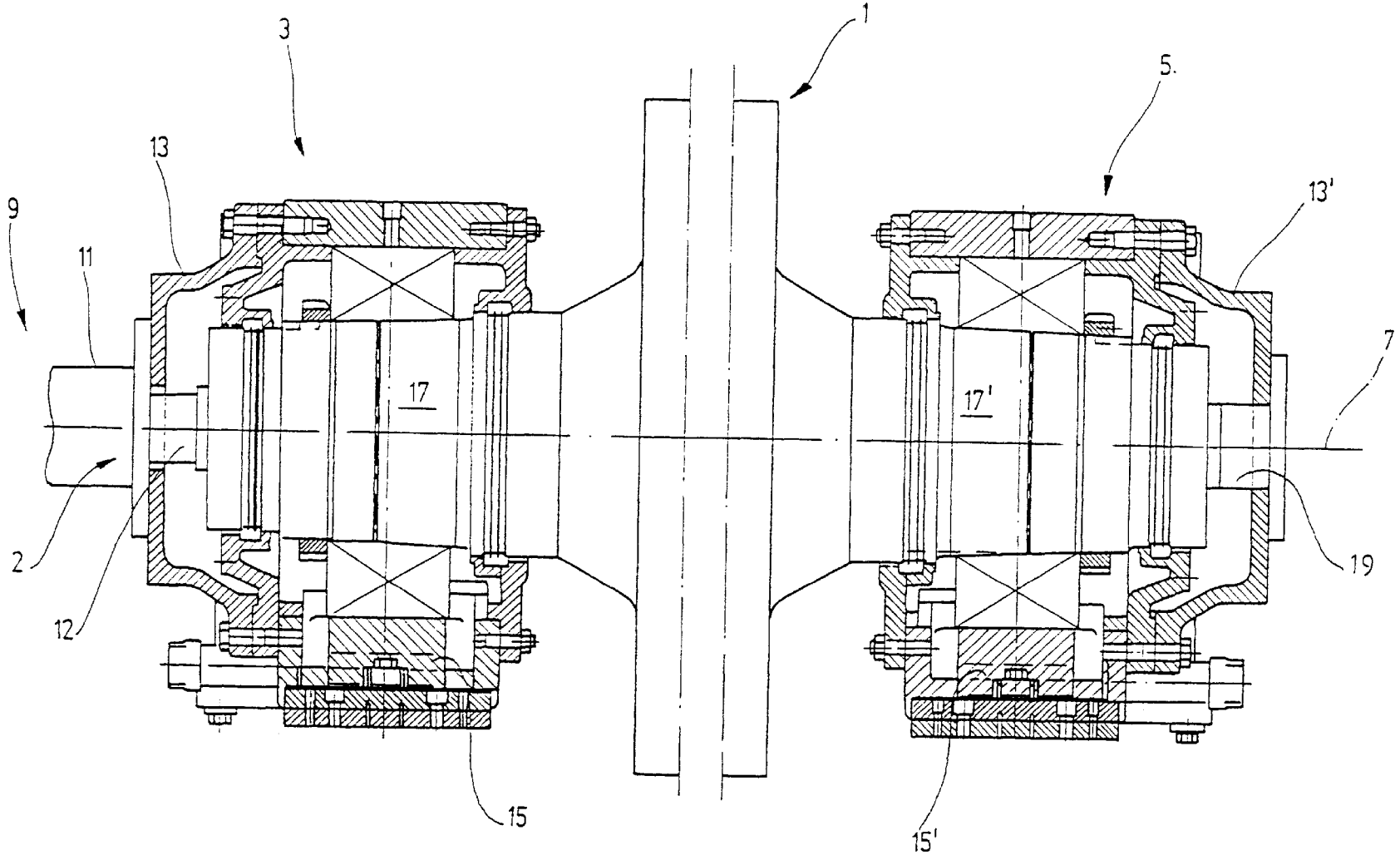
FIG. 1 is a schematic cross section of a side view of a roller belonging to an apparatus for producing layers of material.

Referring now to FIG. 1, there is shown a side view of the end sections of roller 1 which is held in two bearings 3 and 5. The two bearings 3 and 5 are set up as movable bearings, preferably as so-called, CARB—bearings, which allow axial movement of roller 1. Axial movement is movement in the direction of axis of rotation 7. For example, bearings 3, 5 can be set up so that they permit movement along axis of rotation 7 of between approximately 25 mm and 35 mm.

A driving mechanism 9 is mounted to end face 2 of roller 1 or to an axle journal 17. In order to keep the schematic simple and understandable, driving mechanism 9 is only shown as a hydraulic cylinder 11 with a piston rod 12 attached to its end. Piston rod 12 can be moved along the direction of axis of rotation 7. Piston rod 12 is shown as penetrating housing 13 of bearing 3. Hydraulic cylinder 11 on housing 13 of bearing 3 (FIG. 1) is to be positioned such that cylinder rod 12 is in alignment with axis of rotation 7 of roller 1. This configuration furthermore facilitates that drive mechanism 9 moves piston rod 12 of hydraulic cylinder 11 from left to right, a movement which is simultaneously forced upon roller 1.

Left bearing 3 is built so that axle journal 17, which constitutes part of roller 1, is allowed to move along the direction of axis of rotation 7 relative to a fixed frame or to an outer ring 15 which is connected to a so-called seating.

Right bearing 5 is built identically. It also contains an outer ring 15' which enables axial movement of an axle journal 17'. Bearing 5 is contained in a housing 13'. In contrast to bearing 3, housing 13' of bearing 5 contains a spring system 19, for example a spring box. This is built so that a spring force is acting from right to left upon axle journal 17, thus acting against the movement of hydraulic cylinder 11 and piston rod 12, respectively.

Bearing 5 is also mounted on a rigid support or, for example, on the seating of the apparatus that produces material layers. Both bearings 3 and 5 are mounted so that movement of housing 13 and 13' along axis of rotation 7 is not possible. Because of the internal construction of bearings 3 and 5, movement of axle journals 17 and 17' is made possible relative to outer rings 15 and 15' or to bearings 3 and 5, respectively. It is explicitly stated that axle journals 17 and 17' are to be linked directly or through appropriate connecting pieces to roller 1.

Driving mechanism 9 is constructed and employed such that it can move roller 1, as roller 1 is in the process of handling material layers, back and forth in an oscillating fashion. In other words, as mechanism 9 is activating hydraulic cylinder 11 to extend, roller 1 moves from left to right, and as mechanism 9 is deactivating hydraulic cylinder 11, spring system 19 forces roller 1 back from right to left. As mentioned before, the stroke of the motion can be, for example, between approximately 20 mm and 25 mm. Hydraulic cylinder 11 and spring system 19 clamp firmly around the outer ends of roller 1 so that they can limit the axial movement of roller 1 to a regime that can be easily controlled and adjusted. Hydraulic cylinder 11 and piston rod 12 take on the role of an axial bearing, while spring system 19 counteracts, thus playing the role as a counter bearing.

It is also possible to replace hydraulic cylinder 11 with a double action cylinder to connect its piston rod, by use of a jointed link for example, with axle journal 17. It would then be possible to let the double action cylinder take on the role of spring system 19 and thus eliminate the spring system altogether. This substitution would free space at the side of axle journal 17' so that, for example, supply tubing and ducts could be installed.

Figure 2:
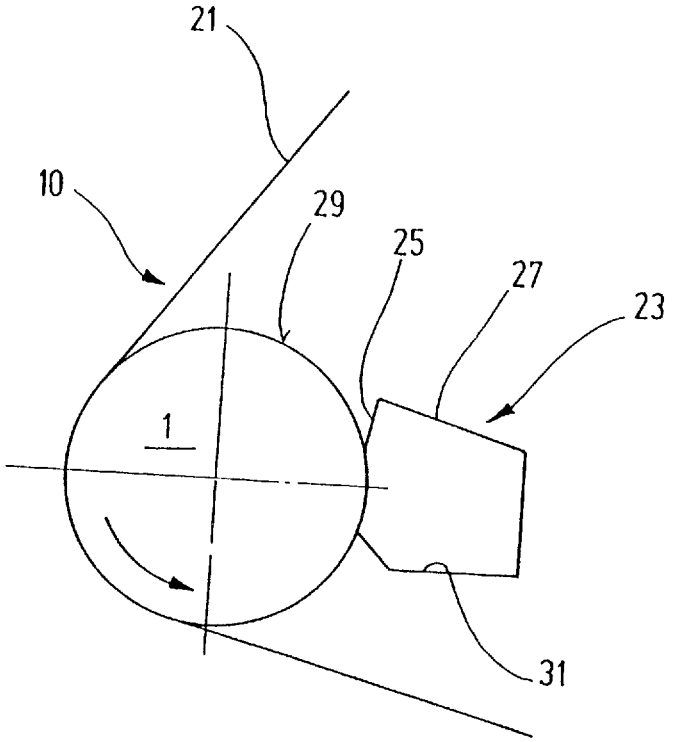
FIG. 2 is a schematic end view of a cylinder acting in conjunction with a cleaning tool.

FIG. 2 depicts a schematic side view of an apparatus to produce a continuous layer of material, or, as an example, an apparatus 10 to produce a continuous paper layer 21 with a roller 1 around which continuous layer 21 is guided along with a conveyer band. A directional arrow on roller 1 indicates that as the apparatus 10 to produce continuous material layer 21 is operating, roller 1 is turning in a counter-clockwise direction. Roller 1 is at its ends equipped with bearings 3, 5 (FIG. 1). Roller 1 is set into an oscillating motion by a driving mechanism that is not depicted in FIG. 2.

Cleaning tool 23, which is mounted in a fixed position into apparatus 10, is working surface 29 of roller 1. Roller 1 is therefore making small oscillating movements relative to cleaning tool 23. Cleaning tool 23 includes a scraper 25 which is pressing with a set force and under an acute angle onto surface 29 of roller 1. Scraper 25 is, with the end opposite to surface 29 of roller 1, attached to a suitable fixture, for example to housing 27 of cleaning tool 23. Scraper 25 is removing substances from surface 29 of roller 1. These substances include sediment or additives that have a tendency to attach themselves to surface 29 of roller 1. The particles that are removed by scraper 25 are caught in a collector channel 31 that is part of cleaning tool 23. The particles are transported away and handled in familiar ways.

The schematic display of FIG. 2 shows without a doubt that neither cleaning tool 23 nor scraper 25 has a so-called scraper beam, which is usually a massive construction with complex bearings and housings that altogether require an enormous amount of space. Cleaning tool 23 does not require a heavy or complicated construction either since the force with which scraper 25 presses against surface 29 of roller 1 can be easily generated, for example, with compressed air or by use of a spring system.

Another reason that cleaning tool 23 can be built lightly and relatively small is due to the fact that cleaning tool 23 is fixed stationary within the apparatus 10 to produce continuous material layer 21. Bearings 3, 5 for roller 1 are built as free carrying bearings. Bearings 3, 5 require the same amount of space as common bearings. Since there is only to be a driving mechanism 9 (FIG. 1) at one side of these rollers, the overall complexity is simple and spatial requirements are rather small for apparatus 10 to produce continuous material layer 21 equipped in ways shown by this invention. Furthermore, since driving mechanism 9 is only at one side of roller 1, apparatus 10 is very accessible for maintenance and cleaning work.

All the above mentioned factors show that an oscillating roller makes the cleaning of roller 1 simple and without requiring a heavy or spacious structure for cleaning tool 23. Commonly required scraper beams and the associated bearings and housings are eliminated. In view of the fact that apparatus 10 to produce the continuous layer of material 21 contains a huge number of cylinders and rollers, many of which are commonly equipped with scrapers, oscillating rollers associated with cleaning tools such as made possible by this invention will result in a lot of space savings at a significantly reduced cost compared to conventional machines.

In addition to the last set of implications, it is also possible to apply the advantages that come with the oscillating roller also to an apparatus to produce continuous material layers that is equipped with spreading devices that contain raking elements, by combining the raking motion of the spreading device with the oscillation of the roller and/or cylinder. This sort of arrangement would help to prevent non-uniform wear of the spreading blade of the raking element. This in turn will help to ensure that coatings which are applied onto moving layers of material are of uniform thickness across the entire width of the layer of material.

It becomes apparent that oscillating rollers or cylinders can be best applied where there is contact between a functional device and the surface of a rotating cylinder or roller.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for the manufacture of a continuous layer of material, comprising:

at least one roller carrying the continuous layer of material, each said roller having an axis of rotation and an outer surface, one of said rollers comprising a guide roller including a first end, a second end, and at least one bearing allowing axial movements in opposite directions along said axis of rotation;

at least one stationary cleaning tool associated with said outer surface of said one roller; and a driving mechanism attached to said first end of said one guide roller and applying a force thereto, thereby moving said one guide roller in said opposite directions along said axis of rotation in an oscillating manner a distance sufficient to effect cleaning of said one guide roller with said at least one cleaning tool.

2. The apparatus of claim 1, wherein said one roller includes an axle journal at said second end, said at least one bearing including a first bearing having a housing and mounted to said axle journal, and further comprising a spring system mounted to said first bearing, said spring system being disposed between and exerting opposite axial forces against said housing of said first bearing and said axle journal, thereby forcibly opposing said force applied by said driving mechanism.

3. The apparatus of claim 2, wherein said at least one bearing includes a second bearing, each of said first bearing and said second bearing comprising free carrying bearings.

4. The apparatus of claim 1, wherein said stationary cleaning tool includes a housing and a scraper, said housing holding said scraper, said scraper mounted substantially parallel to said axis of rotation of said one roller.

5. Apparatus for the manufacture of a continuous layer of material, comprising:

at least one roller carrying the continuous layer of material, each said roller having an axis of rotation and an outer surface, one of said rollers comprising a roller including a first end, a second end, and at least one bearing allowing axial movements in opposite directions along said axis of rotation a distance between approximately 20 mm and 35 mm;

a driving mechanism attached to said first end of said one roller and applying a force thereto, thereby moving said one roller in said opposite directions along said axis of rotation in an oscillating manner; and at least one stationary cleaning tool associated with said outer surface of said one roller.

* * * * *